US005641116A

United States Patent [19]

Martin

[11] Patent Number: 5,641,116

[45] Date of Patent: Jun. 24, 1997

[54] CARD HAVING MAGNETIC SHEET SECURED TO ONE SURFACE WITH A MAILING SPACER THEREON

[75] Inventor: John J. Martin, Louisville, Ky.

[73] Assignee: Crane Productions, Inc., Louisville, Ky.

[21] Appl. No.: 543,815

[22] Filed: Oct. 16, 1995

Related U.S. Application Data

[63] Continuation-in-part of Ser. No. 915,537, Jul. 20, 1992, Pat. No. 5,458,282, and a continuation-in-part of Ser. No. 484, 990, Jun. 6, 1995.

[51] Int. Cl.[6] ..... B42D 15/02; B42D 15/04

[52] U.S. Cl. ..... 229/92.8; 283/56

[58] Field of Search ..... 229/92.8; 283/56

[56] References Cited

U.S. PATENT DOCUMENTS

| | | | |
|---|---|---|---|
| 1,264,795 | 4/1918 | Hill | 229/92.8 |
| 2,805,816 | 9/1957 | Morgan | 229/92.8 |
| 4,887,763 | 12/1989 | Sano | 229/92.8 |
| 4,957,311 | 9/1990 | Geisenheimer | 283/56 |
| 5,036,310 | 7/1991 | Russell | 340/569 |
| 5,085,470 | 2/1992 | Peach et al. | 283/58 |
| 5,459,282 | 10/1995 | Martin | 229/92.8 |

*Primary Examiner*—Stephen P. Garbe

*Attorney, Agent, or Firm*—Middleton & Reutlinger; James C. Eaves, Jr.

[57] ABSTRACT

A card comprising a planar blank having a first planar surface and a second planar surface, the planar blank having at least one line of perforations dividing it into a first section and a second section; a thin, flexible, magnetic sheet material having magnetic materials therein, the magnetic sheet material having a first side and a second side, the magnetic sheet material being capable of magnetically holding the card to a magnetic substance, the first side of the magnetic sheet material being secured to the first planar surface within the first section; where the first section of the card having the magnetic sheet material secured thereto can be separated from the second section of said card along the at least one line of perforations; and, a spacer being removably secured to the second side of the magnetic sheet material.

20 Claims, 2 Drawing Sheets

CARD HAVING MAGNETIC SHEET SECURED TO ONE SURFACE WITH A MAILING SPACER THEREON

BACKGROUND OF THE INVENTION

This is a continuation-in-part ("CIP") application to my U.S. patent application Ser. No. 07/915,537, filed Jul. 20, 1992, now U.S. Pat. No. 5,458,282, and U.S. patent application Ser. No. 08/484,990, filed Jun. 6, 1995, both incorporated herein by reference.

(a) Field of the Invention

The present invention relates to cards such as post cards, greeting cards, advertising cards, pocket cards and the like, and more particularly to such cards having a magnetic material for removably attaching the card to a magnetic surface for display of the card. In order for the card to be mailed and pass through electronic sorting equipment, the magnetic material has a removable spacer thereon.

(b) Description of the Prior Art

There are no cards known to me which include a removable spacer on the magnetic material which permit the card to pass through the mail sorting equipment.

U.S. Pat. No. 4,957,311, to Geisenheimer, teaches a direct mail advertising system having a bulk mail card separable into two portions along a perforation line. U.S. Pat. No. 5,036,310, to Russell, teaches a remote mail delivery system where a permanent magnet 17 placed inside an envelope 18 or affixed to a postcard activates the electronic notification system.

SUMMARY OF THE INVENTION

The present invention provides a card having a magnet on one surface thereof for attachment to a metallic surface so that the card can be displayed. The card may be flat or folded to form a pocket for holding an insert. For mailing, the magnetic material has a removable spacer thereon.

The present invention further provides a card of the class described, wherein the card has first and second planar surfaces and is formed with perforations dividing the card into first and second sections and providing for the separation of the first section from the second section, and has a thin, flexible, magnetic sheet material secured to one planar surface of one of the sections, the magnetic sheet material having a removable spacer thereon for mailing.

The present invention also provides a card of the class described immediately above, wherein the thin, flexible, magnetic sheet material is dimensionally coextensive with the section of the card to which it is secured.

More particularly, in one embodiment, the present invention provides a card comprising a planar blank having a first planar surface and a second planar surface, at least one line of perforations extending across the planar blank dividing the planar blank into first and second sections providing for the separation of the first section from the second section, and a thin, flexible, magnetic sheet material adhesively secured to the first planar surface of the first section, the magnetic sheet material having a removable spacer thereon.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
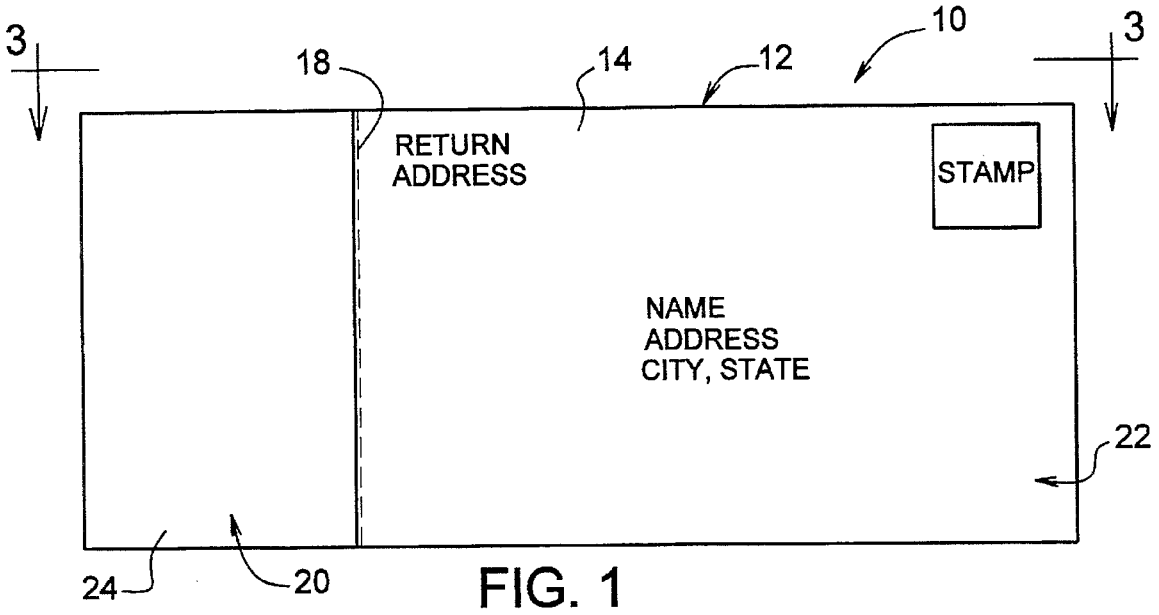
FIG. 1 is a front view of a post card incorporating features of the present invention.
Figure 2:
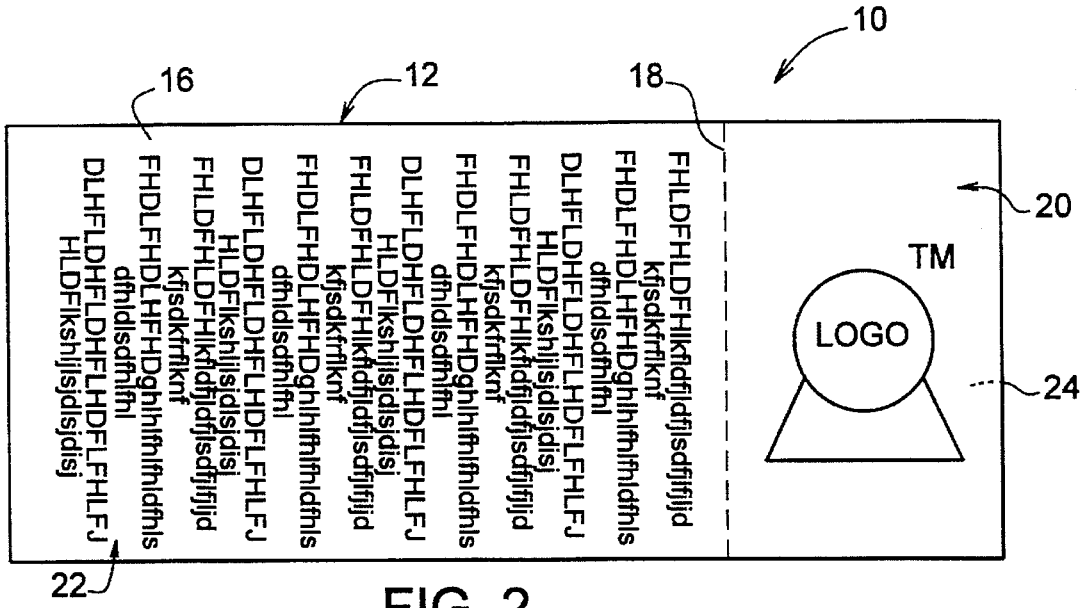
FIG. 2 is a back view of the post card of FIG. 1.
Figure 3:
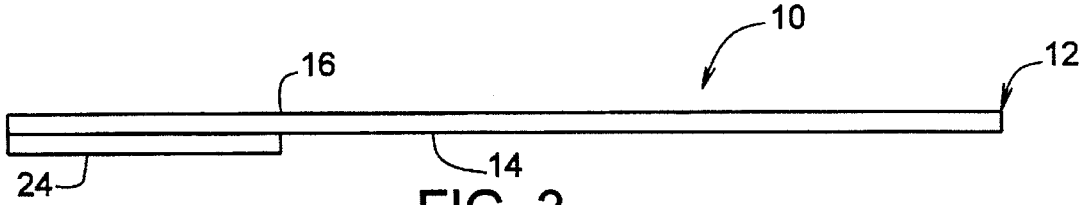
FIG. 3 is a side edge view of the post card of FIG. 1 as seen in the direction of arrows 3—3 in FIG. 1.

With reference to FIGS. 1–3, there is shown a post card, generally denoted as the numeral 10 of the present invention. The post card 10 is formed of a planar blank 12 having a first planar surface 14 and a second planar surface 16. The planar blank 12 is formed with a line of perforations 18 extending across the planar blank 12 dividing the planar blank into a first section 20 and a second section 22. The line of perforations provides for separating the first section 20 from the second section 22. A thin, flexible, magnetic sheet material 24 is adhesively secured to, for example, the first surface 14, of, for example, the first section 20. The thin, flexible, magnetic sheet material 24 is dimensionally coextensive with the first surface 14 of the first section 20. The first surface 14 of the second section 22 can be printed with indicia indicating the location of a postage stamp, location of addressee information, and location of return address information. The second surface 16 of the first section 20 as well as the second surface 16 of the second section 22 can be printed with indicia such as attractive art work, printed information, and the like.

The post card 10 can be magnetically secured to a magnetic surface, such as a refrigerator door or magnetic bulletin board, and the like, to display the card 10. Also, the first section 20 can be separated from the second section 22 along the line of perforations 18 and the separated first section 20 can then be magnetically secured to a magnetic surface, such as a refrigerator door or metallic bulletin board to display the indicia on the second surface 16 of the first section 20. Also, the first section 20 can be used to magnetically attach other sheets of paper, such as notes, to the magnetic surface.

The thin sheet of flexible magnetic material 24 is known and is a vinyl material including magnetic materials dispersed therethrough. Such a sheet of flexible magnetic material can be commercially purchased under the trademark "UltraMag" from FlexMag Industrial, Inc., a Division of Dynacast Co., Marietta, Ohio.

Figure 4:
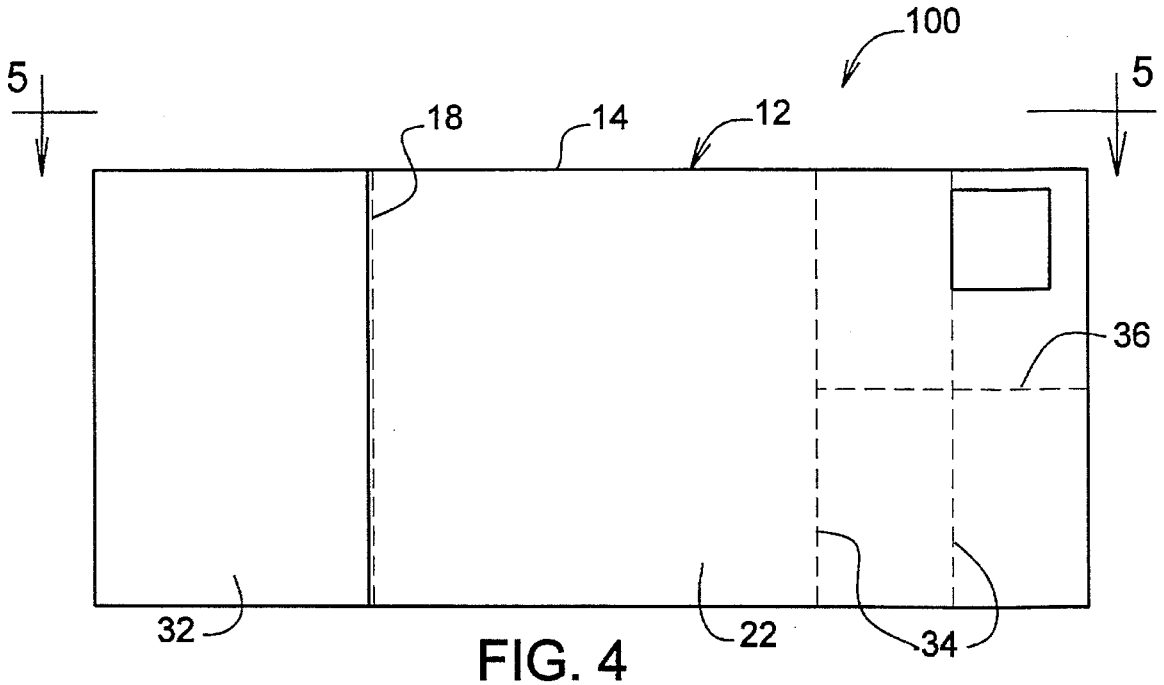
FIG. 4 is a front view of a post card including the removable spacer.
Figure 5:
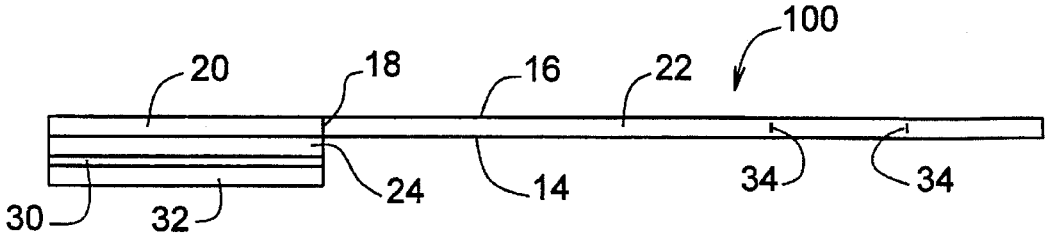
FIG. 5 is a side edge view of the greeting card of FIG. 4 as seen in the direction of arrows 5—5 in FIG. 4.

Card 100 of FIGS. 4 and 5 is similar to card 10 of FIGS. 1–3, except card 100 includes a spacer 32 removably attached to magnetic sheet material 24 by adhesive means 30. For example, spacer 32 can be a vinyl or paper material with a thickness approximately equal to the thickness of magnetic sheet material 24. Magnetic sheet material 24 and spacer 32 are, for example, each about 15 mils (0.015 inch) thick. With this thickness, the magnetic sheet material 24 will not interfere with the post office sorting equipment, so the card 100 can be mailed by first class mail. While magnetic sheet material 24 is preferably permanently adhesively secured to first section 20 of planar blank 12, spacer 32 is removably secured to magnetic sheet material 24. Spacer 32 may contain a repositionable non-permanent adhesive directly thereon, or a polyester material having a repositionable non-permanent adhesive on one side and a permanent adhesive on the other side can be used between the spacer 32 and the magnetic sheet material 24. These are identified as adhesive means 30.

Card 100 is shown having section 22 having additional perforation lines, shown as lines 34 parallel to line 18 and line 36 transverse thereto. These additional perforation lines make removable coupons.

While cards 10 and 100 are shown having the address label and the magnetic sheet material 24 on first surface 14, they do not need to be on the same side of blank 12.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A card comprising:

a. a planar blank, said planar blank having a first planar surface and a second planar surface, said planar blank having at least one line of perforations dividing said planar blank into a first section and a second section;

b. a thin, flexible, magnetic sheet material having magnetic materials therein, said magnetic sheet material having a first side and a second side, said magnetic sheet material being capable of magnetically holding said card to a magnetic substance, said first side of said magnetic sheet material being secured to said first planar surface within said first section; where said first section of said card having said magnetic sheet material secured thereto can be separated from said second section of said card along said at least one line of perforations; and, c. a spacer, said spacer being removably secured by adhesive means to said second side of said magnetic sheet material.

2. The card of claim 1, where said first section has a length and a width and where said magnetic sheet material and said spacer are generally dimensionally coextensive with said length and said width of said first section.

3. The card of claim 1, further comprising indicia printed on at least said first section on said second planar surface.

4. The card of claim 1, further comprising indicia printed on at least said second section of said second planar surface.

5. The card of claim 1, further comprising indicia printed on said second planar surface.

6. The card of claim 1, where said magnetic sheet material is adhesively secured to said first planar surface within said first section.

7. The card of claim 1, further comprising mailing indicia on said first planar surface within said second section.

8. The card of claim 1, where said second section includes at least one line of perforations for separating said second section into a plurality of subsections.

9. The card of claim 2, where said second section includes at least one line of perforations for separating said second section into a plurality of subsections.

10. The card of claim 8, where said at least one line of perforations for separating said second section into a plurality of subsections comprises at least a first line of perforations and a second line of perforations, said first line of perforations being transverse to said second line of perforations.

11. The card of claim 9, where said at least one line of perforations for separating said second section into a plurality of subsections comprises at least a first line of perforations and a second line of perforations, said first line of perforations being transverse to said second line of perforations.

12. The card of claim 1, where said spacer is a material selected from the group consisting of vinyl and paper.

13. The card of claim 1, where said adhesive means includes a repositionable non-permanent adhesive.

14. The card of claim 13, where said repositionable non-permanent adhesive is directly between said spacer and said second side of said magnetic sheet material.

15. The card of claim 13, where said repositionable non-permanent adhesive is adhered to a first side of a thin polyester material said thin polyester material having a permanent adhesive adhered to a second side, said permanent adhesive engaging said spacer and said repositionable non-permanent adhesive engaging said second side of said magnetic sheet material.

16. In combination with a card having a first side of a magnetic sheet material secured to a first side of said card, the improvement which comprises: a spacer, said spacer being removably secured by adhesive means to a second side of said magnetic sheet material.

17. The card of claim 16, where said adhesive means includes a repositionable non-permanent adhesive.

18. The card of claim 17, where said repositionable non-permanent adhesive is directly between said spacer and said second side of said magnetic sheet material.

19. The card of claim 17, where said repositionable non-permanent adhesive is adhered to a first side of a thin polyester material said thin polyester material having a permanent adhesive adhered to a second side, said permanent adhesive engaging said spacer and said repositionable non-permanent adhesive engaging said second side of said magnetic sheet material.

20. The card of claim 16, where said card includes at least one line of perforations.

* * * * *